US006897615B2

(12) United States Patent
Janos et al.

(10) Patent No.: US 6,897,615 B2
(45) Date of Patent: May 24, 2005

(54) PLASMA PROCESS AND APPARATUS

(75) Inventors: Alan C. Janos, Darnestown, MD (US); David Ferris, Rockville, MD (US); Ivan Berry, Ellicott City, MD (US); Michael G. Ury, Great Barrington, MA (US)

(73) Assignee: Axcelis Technologies, Inc., Beverly, MA (US)

( * ) Notice: Subject to any disclaimer, the term of this patent is extended or adjusted under 35 U.S.C. 154(b) by 201 days.

(21) Appl. No.: 10/004,523

(22) Filed: Nov. 1, 2001

(65) Prior Publication Data

US 2002/0135308 A1 Sep. 26, 2002

Related U.S. Application Data

(63) Continuation-in-part of application No. 09/838,234, filed on Apr. 20, 2001.

(60) Provisional application No. 60/199,810, filed on Apr. 26, 2000.

(51) Int. Cl.[7] ..... H01J 7/24; H05B 32/26

(52) U.S. Cl. ..... 315/111.21; 315/111.71

(58) Field of Search ..... 315/111.21, 111.41, 315/111.51, 111.71

(56) References Cited

U.S. PATENT DOCUMENTS

| | | | | |
|---|---|---|---|---|
| 4,047,064 A | | 9/1977 | Cosco et al. | 313/201 |
| 4,447,958 A | | 5/1984 | Tanaka | 33/174.2 |
| RE32,626 E | | 3/1988 | Yoshizawa et al. | 315/39 |
| 4,762,603 A | * | 8/1988 | Morin | 174/74 R |
| 4,863,576 A | * | 9/1989 | Collins et al. | 204/192.15 |
| 4,922,099 A | * | 5/1990 | Masuda et al. | 250/324 |
| 5,639,565 A | * | 6/1997 | Boyd et al. | 428/328 |
| 5,686,793 A | | 11/1997 | Turner et al. | 313/570 |
| 5,847,517 A | * | 12/1998 | Ury et al. | 313/231.61 |
| 5,892,328 A | * | 4/1999 | Shang et al. | 313/17 |
| 6,084,348 A | * | 7/2000 | Love | 313/484 |
| 6,239,553 B1 | * | 5/2001 | Barnes et al. | 118/723 AN |
| 6,351,070 B1 | * | 2/2002 | Barry | 315/248 |

FOREIGN PATENT DOCUMENTS

| | | | |
|---|---|---|---|
| EP | 0 002 848 | 5/1981 | H01J/61/54 |
| JP | 57055057 | 4/1982 | H01J/65/04 |
| JP | 57202644 | 12/1982 | H01J/65/04 |
| JP | 58005960 | 1/1983 | H01J/65/04 |
| WO | WO 98/56213 | 12/1998 | H05B/37/00 |
| WO | WO 99/08865 | 2/1999 | B31F/1/07 |
| WO | WO0030142 | 5/2000 | H01J/17/16 |

* cited by examiner

*Primary Examiner*—Wilson Lee
*Assistant Examiner*—Minh Dieu A
(74) *Attorney, Agent, or Firm*—Cantor Coblurn LLP

(57) ABSTRACT

An apparatus and process for enhancing the ignition of a gas to form a plasma in a plasma tool. The apparatus and process includes the use of a plasma tube to locally enhance the applied electric field so that plasma can be initiated at higher pressures, at lower electric fields, and/or in otherwise difficult gases to ignite. The plasma tube includes at least one conductive fiber secured to the tube. A process for enhancing the local electric field includes coupling the plasma tube to an energy source such as microwave energy, radiofrequency energy, or a combination comprising at least one of the foregoing energy sources.

37 Claims, 11 Drawing Sheets

PLASMA PROCESS AND APPARATUS

CROSS REFERENCE TO RELATED APPLICATIONS

The present application is a continuation-in-part application of, and claims priority from, U.S. patent application Ser. No. 09/838,234, entitled "Lamp Utilizing Fiber for Enhanced Starting Field" filed on Apr. 20, 2001,which application claims the benefit of the date of an earlier filed provisional application, having U.S. Provisional Application No. 60/199,810, filed on Apr. 26, 2000, hereby incorporated by reference in their entireties.

FIELD OF INVENTION

The present disclosure relates generally to fabrication of integrated circuits, and more particularly, to plasma mediated processing and apparatuses employed for fabricating the integrated circuit.

BACKGROUND OF THE INVENTION

In the process of fabricating integrated circuits (IC's) on wafers, the wafers are subjected to many process steps before a finished IC is produced. The wafers are typically processed with a myriad of specialized tools for forming the various features of the IC, with many of the steps repeated several times. Specialized tools utilized in the IC fabrication process include, but are not limited to, photolithography tools, etchers, ashers, photostabilizers, ion implantation equipment and the like. A significant number of these tools expose the wafer or selected portions of the wafer to a plasma.

Typically, the tools that employ a plasma generate the plasma in close proximity to the wafer surface or produce reactants that interact with the wafer, such as for etching of materials, ashing of photoresist, deposition of materials or the like. Plasma tools are also employed for generating light, such as for example, during photostabilization processes, curing processes, charge erasure processes, and the like. Some plasma-mediated processes employ plasma discharges that are either difficult to ignite, or ignite, but do so irreproducibly with variable delays before ignition is achieved. Once ignited, these discharges are typically sustained with lower required voltages or reduced electric fields. Unfortunately, variability in ignition can lead to variability in processing, inefficiencies, and reduced throughput.

In the semiconductor industry, throughput is often a very important issue. With large volumes and low profit margins in the more competitive areas, incremental improvements in throughput can provide the necessary edge to compete successfully. Variability associated with plasma ignition is often a cause for decreased throughput since process times have to be adjusted to account for the variability.

One causal factor for the difficulty in igniting a gas to form a plasma is due to the relatively high pressures of the working gas. Gases generally have a minimum breakdown voltage operating point that corresponds to relatively low pressures, pressures generally less than about 400 torr and more typically about less than 200 torr. As the gas pressure increases, the required voltage, or electric field, needed to break down the gas increases monotonically. This behavior is problematic since some processes benefit from operation at relatively high pressures, even up to atmospheric-type pressure ranges, at which point very high voltages are required to break down the gas.

Another causal factor for difficulty in plasma ignition is the use of electronegative gases or gas mixtures. Electronegative gases are gases that have a high affinity for electron capture, so that it is very difficult for electrons, once generated, to accelerate and create more free electrons from collision to cause the gas to break down. As a result, establishing a well behaved, steady state plasma can be difficult since the electronegative gas atoms or molecules recapture the electrons. Unfortunately, electronegative gases are frequently the gases of choice for plasma mediated processing of semiconductor wafers for the manufacture of IC's.

The specialized tools that utilize plasmas are driven by energy sources such as microwaves, radiofrequency (RF), other high frequency sources, or the like. Ignition efficiency with these energy sources is generally poor. For example, in the case of a microwave driven plasma, microwave power supplied by a magnetron can be reflected back into the magnetrons. The power supplied by a magnetron is coupled to a microwave cavity for generating the plasma. For most plasma processes, the microwave power can range up to 5,000 watts (W) with gas pressures ranging from 0.5 torr to greater than 5 torr. A common microwave operating frequency is 2.45 gigahertz (GHz). Through the center of the microwave cavity is a plasma tube running lengthwise. The tube is open ended so that it has a gas feed port on top and a gas/plasma exhaust opening at the bottom, leading into a wafer-processing chamber. It is through this tube that various processing gases are passed. Typical gases can include oxygen, nitrogen, hydrogen, helium, and mixtures of these, as well as electronegative gases such as $CF_4$, $NF_3$, and $CHF_3$. Water vapor can also be added. The combined flow rates for the process gases can be as high as 5000 standard cubic centimeters per minute (sccm) or higher. After power is supplied to the magnetrons but prior to ignition, there is no plasma load to absorb the power and power is reflected back into the magnetrons. Reflected power results in a reduced efficiency of the tool and also results in potential damage to the magnetron source. Moreover, once ignited, improper tuning of the microwave driven plasma can further exacerbate the problem of reflected power.

Many plasma tools include tuning hardware to optimize ignition of the gas to form the plasma as well as provide optimization of the breakdown voltage during steady state operation. The ability to ignite the gas mixture depends on the multi-dimensional space defined by all of these variables: gas, pressure, flow rate, electric field provided by the microwave power, and tuning of the cavity. The tuning hardware generally includes an adjustable antenna and an adjustable short. The tuning of the microwave cavity is achieved by moving the antenna position into and out of the microwave cavity, and moving the adjustable short (i.e., a conducting end-plate) up and down to define the length of the cavity. Tuning further adds to the delays associated with operating the plasma tool and as a result, affects throughput.

Once ignited, the reflected power depends on the same variables. That is, without the cavity tuned properly for the given load, some portion of the microwave energy generated from the magnetron is reflected from the load and returned to the microwave source. This reflected power occurs because the presence or absence of the plasma changes the load as seen by the microwave circuit, and changes the tuning of the resonant microwave cavity since the material within the microwave cavity (plasma versus no plasma) affects the resonant wavelength for the cavity. As previously discussed, reflected power results in reduced efficiency of the tool and potential damage to the magnetron source. FIG. 1 graphically illustrates an example of the reflected power versus antenna position and adjustable short position. As shown, relatively high values (>30%) of reflected power can be encountered without proper tuning. Moreover, it has been observed that the optimum starting position of the antenna is usually not the same as the optimum position once the plasma has ignited. Hence, hardware and software has to be added in order to accommodate the two different optimum positions, thereby increasing the costs associated with the operation and manufacture of the plasma tool.

While the repositioning of the antenna offers the advantages of ignition over a larger operating regime, and improved operation during an "on" phase, there still remains a need for a more robust ignition system and process so that repositioning is not necessary or is minimized. Antenna positioning and adjustment of the short requires time, which impacts throughput. Moreover, the use of the microwave cavity tuning system affects reliability, and adds to the total cost to manufacture the plasma tool as well as operating costs.

SUMMARY OF THE INVENTION

A plasma tool includes a plasma generating chamber comprising a plasma tube, wherein the plasma tube comprises an open ended cylindrical body, wherein the body includes a gas inlet at one end an outlet opening at an other end, and at least one conductive fiber secured to the body; and an energy source in operative communication with the plasma tube.

A process for reducing the electric field breakdown point of a gas includes securing a conductive fiber to a surface of a plasma tube, wherein the plasma tube comprises an open ended cylindrical body, wherein the body includes a gas inlet at one end, an outlet at an other end, and at least one conductive fiber in contact with the body; flowing a gas into the gas inlet of the plasma tube; applying an electric field to the gas flowing in the plasma tube to form a plasma; and discharging the plasma from the outlet of the plasma tube.

These and other objects, advantages and features of the invention will become better understood from the detailed description of the invention that is described in conjunction with the accompanying drawings.

DETAILED DESCRIPTION OF THE INVENTION

A method and apparatus for enhancing the ignition of a gas to form a plasma in a plasma tool includes placing conductive fibers in or near a plasma discharge volume to locally enhance the applied electric field so that plasma can be initiated at higher pressures, at lower electric fields, and/or in otherwise difficult gases to ignite. Advantageously, the process and apparatus reduces the overall process times for igniting the gas and forming a stable plasma discharge. As a result, wafer throughput for plasma-mediated processes is increased, thereby providing a significant commercial advantage.

In a preferred embodiment, at least one conductive fiber is located within or in close proximity to the plasma discharge volume. Preferably, the conductive fiber is disposed in close proximity to a wall of a plasma tube, wherein the plasma discharge volume is first generated. More preferably, the conductive fiber is secured to an interior wall of the plasma tube. The conductive fiber is preferably coated with a protective coating. As will be discussed in further detail below, the plasma tube is generally an open-ended elongated cylindrical body fabricated from quartz, sapphire, alumina-coated quartz or like material. The plasma tube includes a gas feed inlet at one end and plasma exhaust at the other end. The plasma exhaust is generally discharged into a processing chamber. Gases flowing through the tube are excited with an energy source to breakdown the gases and form the plasma discharge volume. An exemplary plasma tool employing a plasma tube is shown in FIG. 2.

The present disclosure is not intended to be limited to any particular plasma tool and is applicable to those plasma-generating tools employing RF, microwave energy or other high frequency energy sources, individually or in combination, to generate the plasma. Suitable plasma tools include downstream ashers, curing plasma tools, photostabilization tools, plasma tools configured for charge erasure and the like, such as for example, the plasma asher commercially available under the trade name FUSION ES3i from the Axcelis Technologies, Inc. in Rockville, Md.

Figure 1:
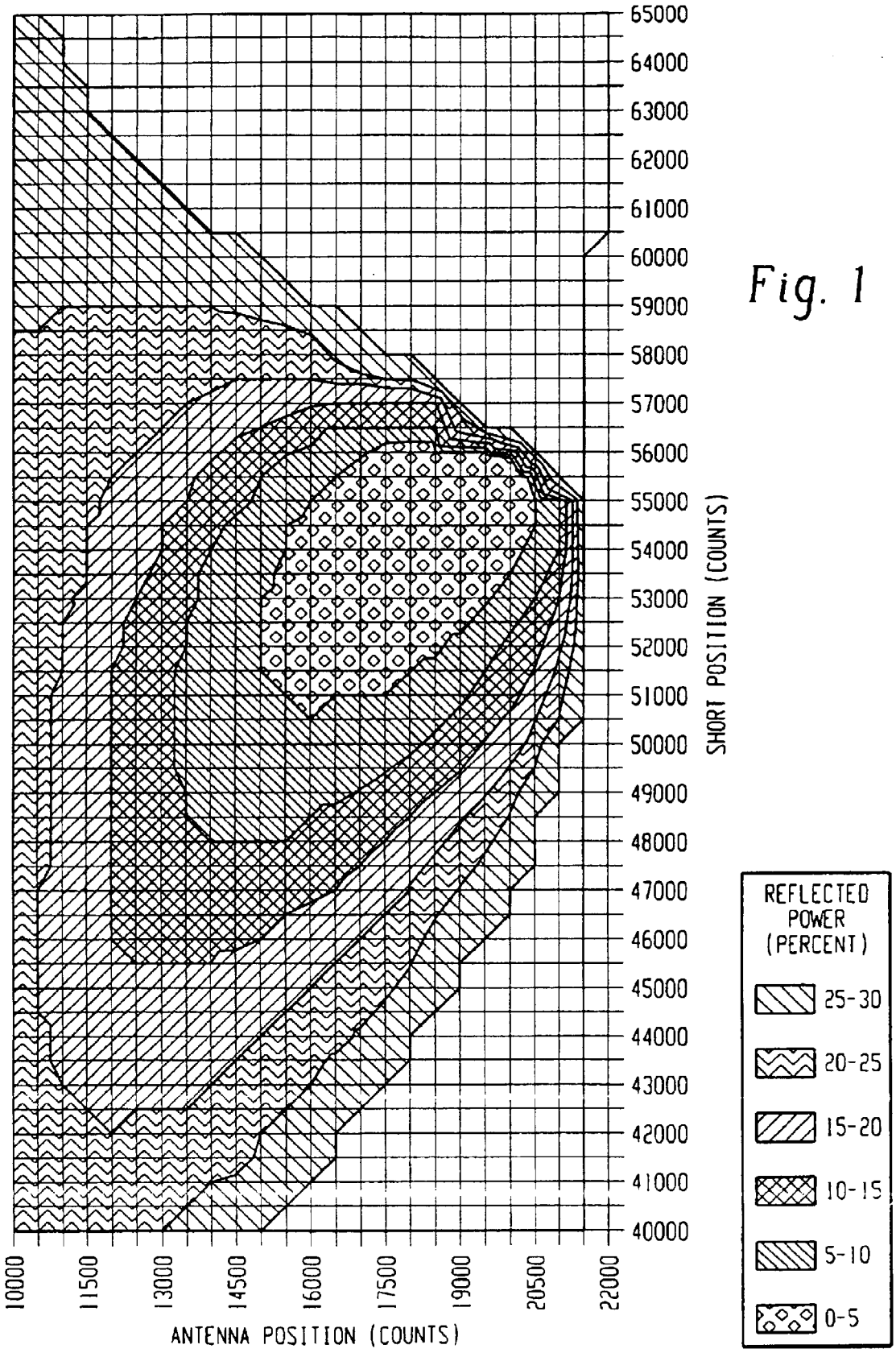
FIG. 1 is a graph depicting percent reflected power as a function of antenna position and short position for a microwave driven plasma tool.
Figure 2:
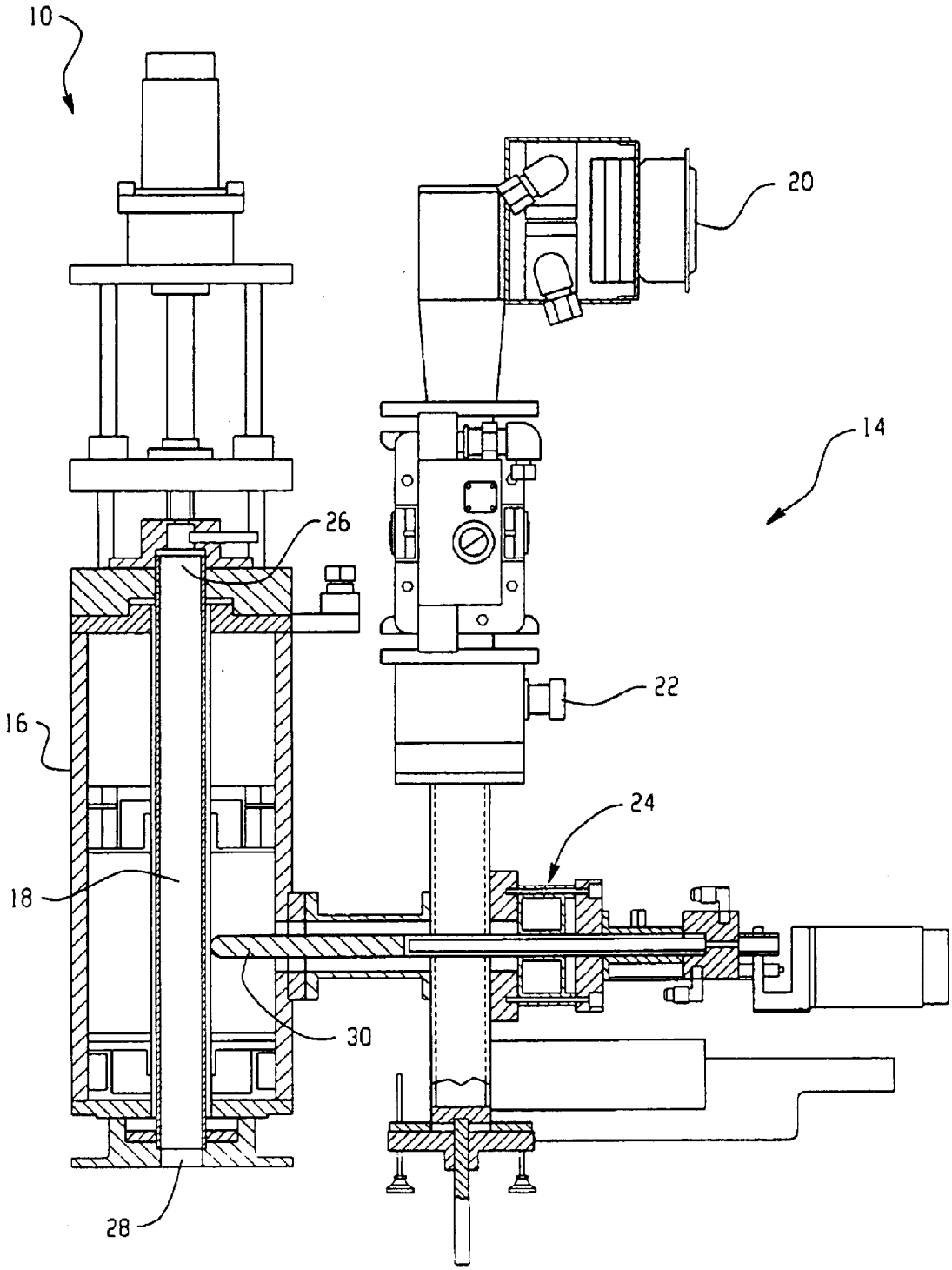
FIG. 2 is a cross section of a microwave downstream plasma system.

Turning now to FIG. 2, the illustrated exemplary plasma tool 10, shown here configured for microwave driven plasma ashing, generally includes a plasma-generating chamber 12, a microwave energy source 14 and a wafer processing chamber (not shown). The plasma-generating chamber 12 includes a microwave cavity 16 having a plasma tube 18 passing therethrough. The microwave cavity 16 is a cylindrical "can-like" structure and is typically fed with microwave energy from the microwave energy source 14 via an antenna 30 protruding into the cavity 16. The plasma tube 18 is an open ended cylindrical body that includes a gas feed inlet 26 at one end and a plasma/gas exhaust 28 at its other end.

The microwave energy source 14 includes a magnetron 20 that provides microwave power through a directional coupler assembly 22 to an adjustable waveguide assembly 24, which couples the microwave energy into the microwave cavity 16 through which the plasma tube 18 extends. The adjustable waveguide assembly 24 includes the adjustable antenna 30 that moves laterally into and out of the microwave cavity and an adjustable short (not shown) that vertically adjusts the length of the cavity 16. Plasma is excited in the gas flowing through the plasma tube 18 and is discharged into a process chamber (not shown) for treating wafers contained therein. The plasma generated within the plasma tube 18 defines the plasma discharge volume.

Figure 3:
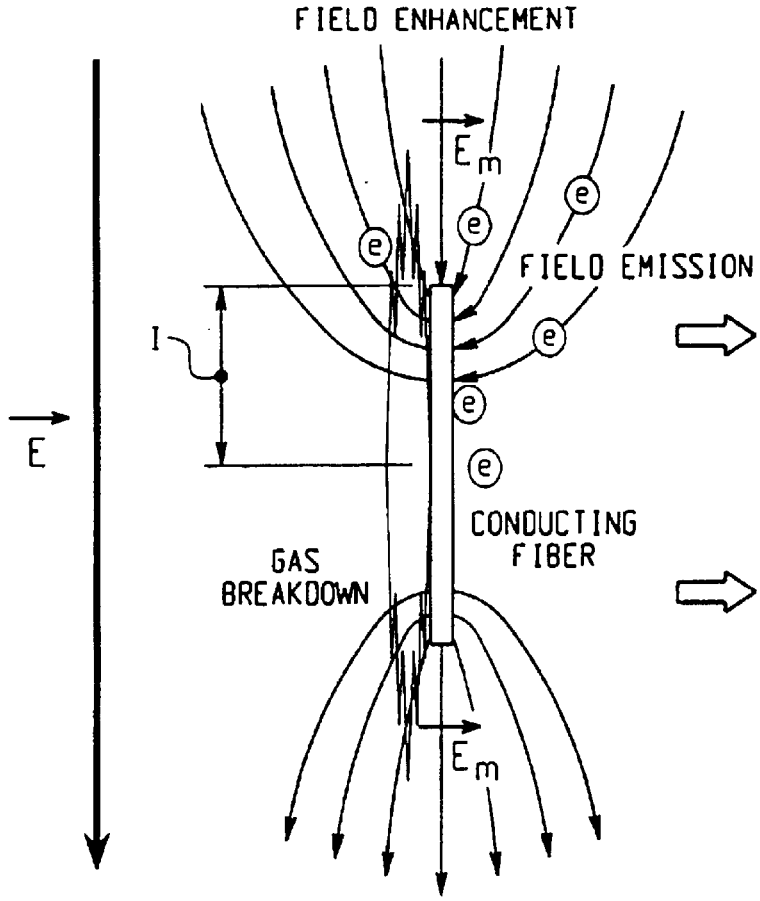
FIG. 3 is a schematic illustration showing the electric field enhancement around a single fiber.

While not wanting to be bound by theory, the presence of a conductive fiber within or in close proximity to the plasma discharge volume enhances the local electric field as shown in FIG. 3. The conductive fiber allows charges (i.e., electrons) to accumulate at each end, thus distorting and enhancing the local electric field within the plasma tube 18. The gas flowing through the plasma tube 18 is exposed to the enhanced local electric field, breaks down and becomes conductive. It is believed that because the fiber resistance is high relative to the volume resistance of the steady state plasma, it does not couple significant energy during steady state operation. This reduces the field enhancement at the tips of the fiber during steady state operation, consequently reducing plasma disturbance and overheating of the fiber during operation.

Figure 4:
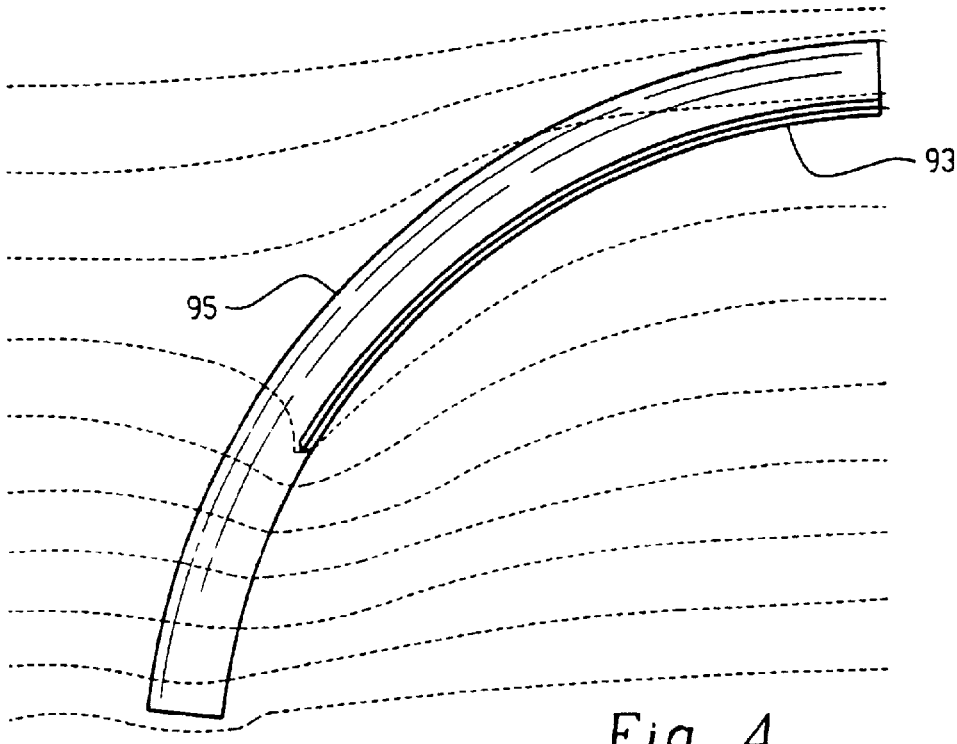
FIG. 4 is a schematic illustration showing equipotential lines for a conductive fiber encased in a non-conductive substrate.

FIG. 4 graphically depicts a modeled electrical field of a 100-micron conductive fiber 93 encased in a 1-millimeter thick quartz substrate 95. The dashed lines represent lines of equipotential. Narrow spacing between the equipotential lines indicates regions of high field strength. Thus, the regions at the tips of the fiber, with equipotential lines that are closer together, represents a region of enhanced electric field (gradient of potential is enhanced). The field strength outside the quartz substrate is lower and less likely to contribute to breakdown of a gas. Alternatively, the fiber may be positioned on the outside wall, i.e., the exterior or interior surfaces of the plasma tube. More preferably, the fiber is disposed on the interior surface of the plasma tube. Note that the plasma tube 18 is chosen to be non-conducting since it is disposed within the microwave cavity 16.

The fiber is fabricated from a conductive material. Preferably, the fiber is fabricated from conductive materials that provide for a relatively high enhancement of the electric field, and is capable of surviving many ignition cycles. Alternatively, the fiber is fabricated from a non-conductive material having conductive domains and/or a conductive coating.

Preferred conductive materials for fabricating the fiber include tantalum, gold, copper, silver, tungsten, molybdenum, aluminum, carbon, graphite, palladium, platinum, ceramics, and composites or compositions comprising at least one of the foregoing materials. Other electrically conductive materials may include conducting polymers, such as polyanaline and polypyrrole, and metal powders entrapped within a thermally and plasma resistant protective coating to produce the conductive fiber. More preferably, the conductive fiber is selected from the group including a platinum fiber, a platinum coated silicon carbide fiber, and a silicon carbide fiber.

The surface resistivity for platinum is about $10^{-5}$ ohm·cm and for SiC fibers the surface resistivity generally ranges from about 1 to about $10^{5}$ ohm·cm. An especially preferred silicon carbon fiber having a surface resistivity of about 1 ohm·cm is commercially available under the trade name Hi-Nicalon™ and is produced by Nippon Carbon Co., Ltd., Tokyo, Japan.

Although the resistivity of a given material is constant, the resistance of a specific volume of the same material is a function of its dimensions and resistivity. In general, the dimensions and resistivity of the fiber are chosen so that the fiber effectively enhances the electrical field yet, is resistive enough so that the fiber does not couple significant energy during steady state operation. The length and shape of the fiber disposed within or in proximity to the plasma discharge are generally unrestricted. The fiber length, depending on the construction, can be between about 50 nanometers to about 10 centimeters depending on the plasma tool and operating conditions. However, for most plasma applications, it is preferred that the length of the fiber is at about 3 millimeters (mm) to about 5 mm. Preferably, the fiber has a substantially circular cross sectional shape. Fibers having substantially non-circular cross sections may be beneficial for particular applications in terms of bonding the fiber to the wall or having a thinner profile for field enhancement. The thickness of each fiber is preferably less than about 100 microns. At thicknesses greater than about 100 microns, it is difficult to protect the fiber from the heat and reactivity of the plasma. Moreover, thicker fibers do not readily conform to the plasma tube surfaces, thus compounding the difficulty in protecting the fiber from the plasma.

There are a number of other variables that may be considered in fabricating or choosing a suitable fiber, well within the skill of those in the art in view of this disclosure. For example, the fiber should possess sufficient mechanical strength and thermal conductivity to prevent degradation or breakage during deposition of the fibers and during operation of the plasma tool, i.e., during ignition, steady state operation of the plasma and shut down. The melting point of the fibers is preferably greater than the temperatures encountered by the fiber during operation of the plasma source.

Figure 5:
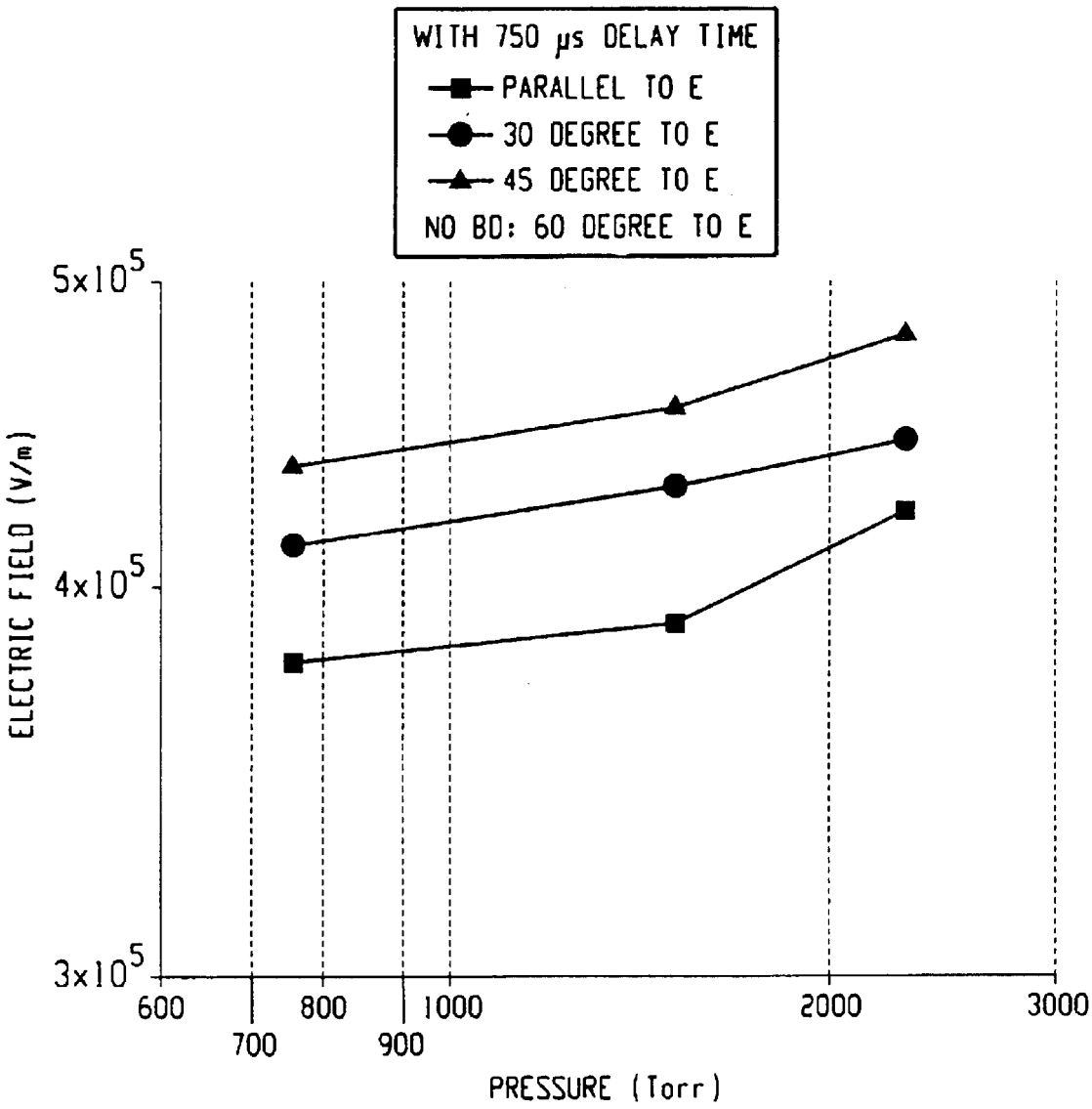
FIG. 5 graphically illustrates the electric field as a function of pressure showing the field strengths required for breakdown of argon gas with conductive fibers at different angles relative to the applied electric field.

The orientation, or angle, of the fiber with respect to the applied electric field is preferably aligned to the applied electric field since charge separation and build-up can only occur along the length of the fiber. More preferably, the fiber is substantially parallel to the applied electric field. With a fiber of fixed length oriented at an angle not substantially parallel to the applied electric field, its effective length along the electric field is reduced by $\cos\theta$, where $\theta$ is the angle of the fiber with respect to the electric field. FIG. 5 graphically illustrates this effect for a 5 mm Hi-Nicalon™ silicon carbide fiber in argon. At an angle of about 60 degrees to the electric field, breakdown of argon did not occur. In contrast, increased electric field enhancement is observed as the angle of the fiber is oriented closer to parallel to the applied electric field.

In the case of multiple fibers being disposed within or in proximity to the plasma discharge volume, it is contemplated that each one of the fibers may be of the same composition or a different composition depending on the intended use of the plasma tool. Multiple fibers are preferred in those plasma tools including a relatively large plasma tube. At large separations, the fibers can act independently and further amplify the enhancement effect. Sufficient fiber separation for most plasma tools may be maintained by spacing the ends of opposing fibers such that the localized discharges (i.e., electron clouds) created by adjacent fiber tips do not interfere (i.e., shield) each other. This translates into a separation of approximately 3 mm. However, operation at smaller separations is still possible, especially if the number of fibers is large, i.e., greater than about 3.

A sol gel coating process is preferably employed to secure the fiber to the plasma tube. The sol gel coating preferably comprises a dielectric material and serves to protect the fiber from the plasma during operation of the plasma tool. Sol gel coating processes are well known in the art. For example, PCT Publication Nos. WO 98/56213 and WO 00/30142 describe various sol gel processes for coating a microwave lamp screen and interior surfaces of a bulb. In general terms, the sol gel solution is formulated to yield the desired coating after evaporation of an organic solvent and subsequent curing at an elevated temperature. Preferably, the desired sol gel coating is formed from a silicon dioxide precursor. The thickness of the sol-gel coating is preferably greater than about 0.1 micron to about 10 microns or more.

An exemplary process for applying the sol gel coating includes the use of a silicon dioxide precursor such a tetraorthoethylsilicate (TEOS) to prepare a sol gel solution. At least one fiber is placed onto a wall of a plasma tube and the sol gel solution is then coated onto the wall. Preferably, the wall is an interior wall of the plasma tube. The coating is then dried and cured at an elevated temperature. Several layers may be applied in this manner. The drying and curing process secures the fiber to the wall. When secured in this manner, a thin layer of the silicon dioxide coating may be between the fiber and the wall. For heat sinking purposes, the fiber is preferably in thermal contact with the plasma tube wall over substantially the entire length of the fiber. However, for thin layers of sol gel between the fiber and the wall, the fiber is still effectively in thermal contact with the wall. In this manner, the plasma tube wall acts as a heat sink. Several additional sol gel layers may be added to ensure that the fiber is sufficiently coated and protected during operation of the plasma tool.

An exemplary sol gel recipe, expressed in molar ratios, includes about 1 part TEOS, about 1 to about 4 parts ethanol, about 0 to about 5 parts water and about 0.1 to about 0.3 parts hydrochloric acid. More preferably, the sol gel recipe includes about 1 part TEOS, about 1 to about 3 parts ethanol, about 0.5 to about 5 parts water and about 0.1 to about 0.3 parts hydrochloric acid. In a preferred embodiment, the sol gel recipe includes 1 part TEOS, about 3 parts ethanol, about 1 part water and about 0.15 parts hydrochloric acid.

In general, it is believed that the resulting dielectric thickness (e.g., silicon dioxide layers) deposited onto the conductive fiber is at about 0.2 to about 0.5 microns. Several layers may be applied and the resulting thickness may still be less than about 1 to about 2 microns. Preferably, the final thickness of the dielectric coatings is effective to inhibit reaction between the plasma and the fiber during operation and facilitate the desired field enhancement. Depending on the applied starting field strength, between 2 and 4 layers of sol-gel applied coatings are preferred.

Figure 6:
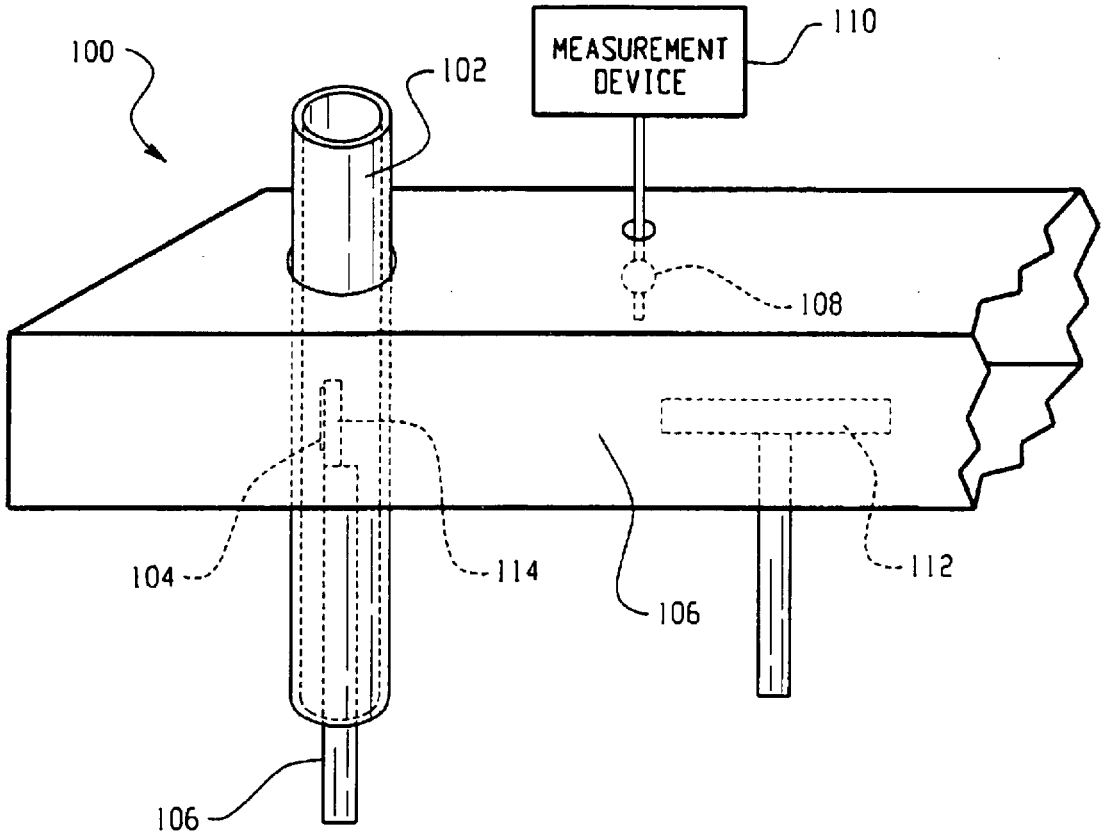
FIG. 6 illustrates a partial perspective view of an apparatus suitable for measuring the breakdown electric field of a gas.
Figure 7:
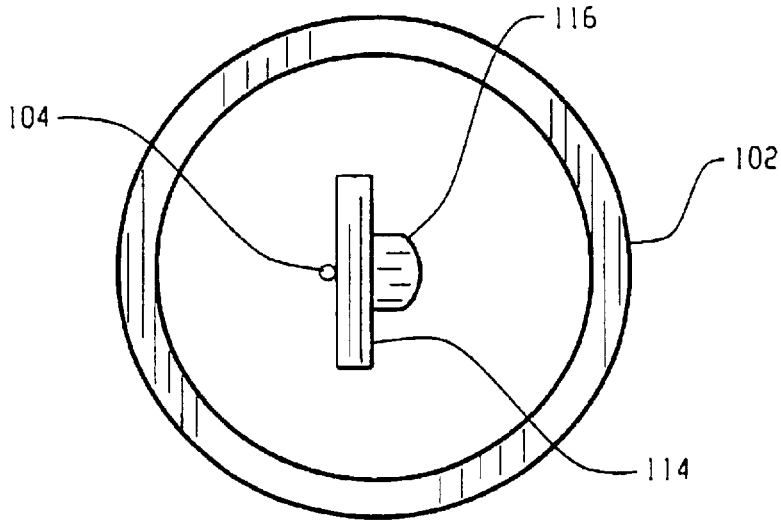
FIG. 7 illustrates a top down cross-sectional view of the plasma tube of FIG. 6.

FIGS. 6 and 7 illustrate an apparatus 100 in which an electric field required to break down a gas can be measured. A cylindrical quartz plasma tube 102 is adapted to be pressurized with a gas and a fiber 104 is positioned within the quartz tube 102 to enhance the local electric field during operation. The plasma tube 102 is open ended so that gases can be continuously introduced, and exhaust gases and reactants can be exited from the plasma portion, just as in the wafer processing tool described above in FIG. 2. A rectangular resonant microwave cavity 106 includes an electric field probe 108 disposed therein to measure the field in the region under test. The probe 108 is connected to a measurement device 110. An adjustable tuner 112 is positioned inside the cavity 106. Accordingly, both the amount of microwave power and the Q of the cavity can be adjusted to set a desired E field. The fiber 104 is positioned on a quartz or sapphire substrate 114. The substrate 114 is mounted on a quartz or sapphire rod 116 and inserted into the quartz tube 102. The tube 102 passes though the cavity 106 such that microwave energy can be applied to the gas inside the tube 102. The fiber 104 is aligned along the electric field. The probe 108 is positioned inside the cavity 106 such that the measured E field at the probe position corresponds to the same E field as that applied to the pressurized gas at the position of the quartz tube 102. In the illustrated apparatus 100, for example, the tube 102 is centered at a distance of ¼ wavelength from the end of the cavity and the probe 108 is positioned a distance of ¾ wavelength from the same end of the cavity 106. The gas type and pressure may be varied within the tube 102, such that the electric field strength and the breakdown delay time may be measured for the different pressures and applied field strengths to characterize the enhancement provided by the fiber 104.

Figure 8:
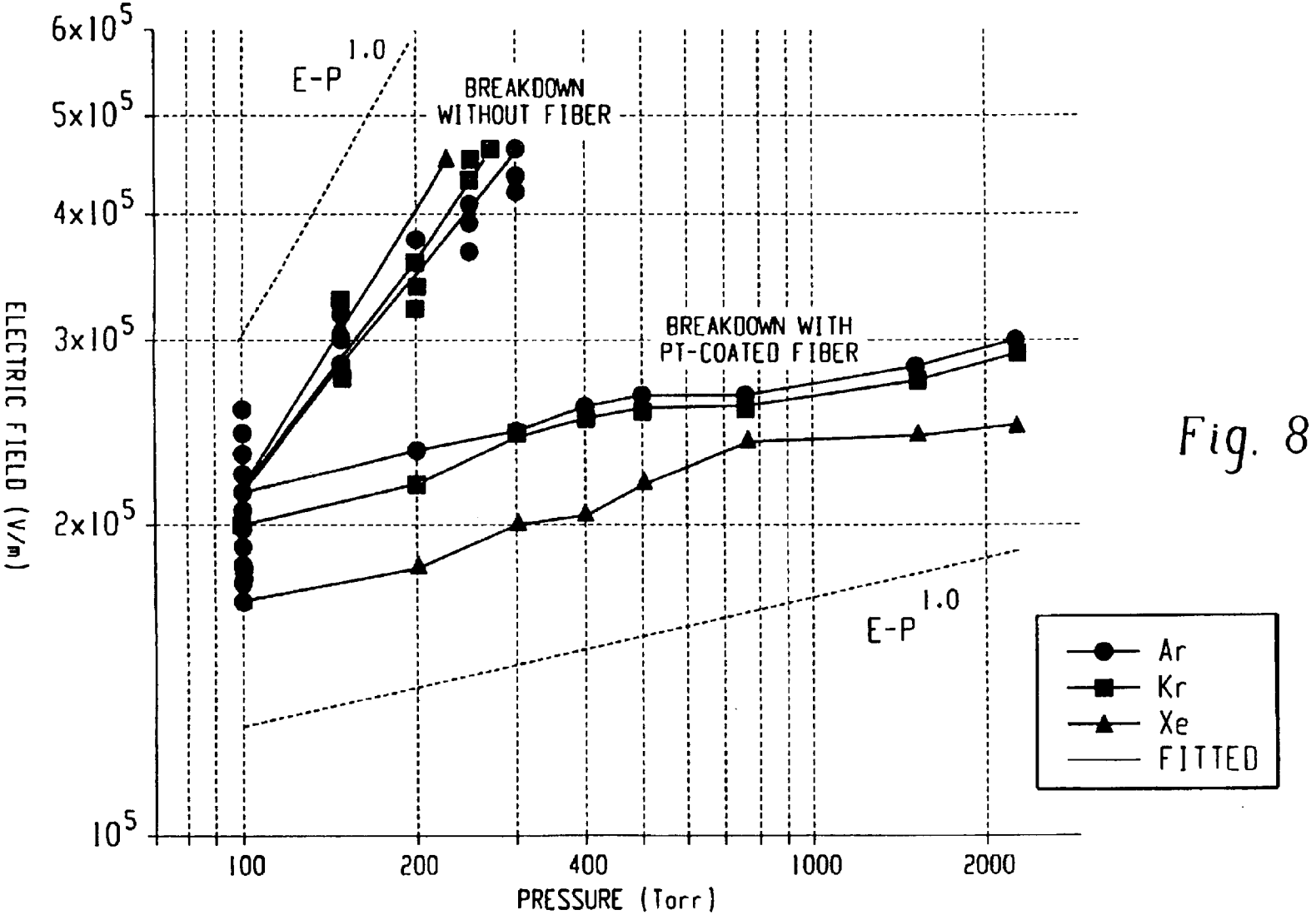
FIG. 8 graphically electric field as a function of pressure showing the field strengths required for breakdown of noble gases with and without an enhanced electric field.

FIG. 8 graphically illustrates the breakdown field for three noble gases commonly employed in plasma-mediated processes. The breakdown field was measured with and without the presence of a conductive fiber in or in close proximity to the plasma discharge volume using the apparatus of FIGS. 6 and 7. In the presence of a platinum coated SiC fiber, the breakdown electrical field for these gases was extended up to 3 atmospheres for the various noble gases. In contrast, breakdown of these gases is limited to a pressure of less than 300 torr without the presence of a conductive fiber.

Figure 9:
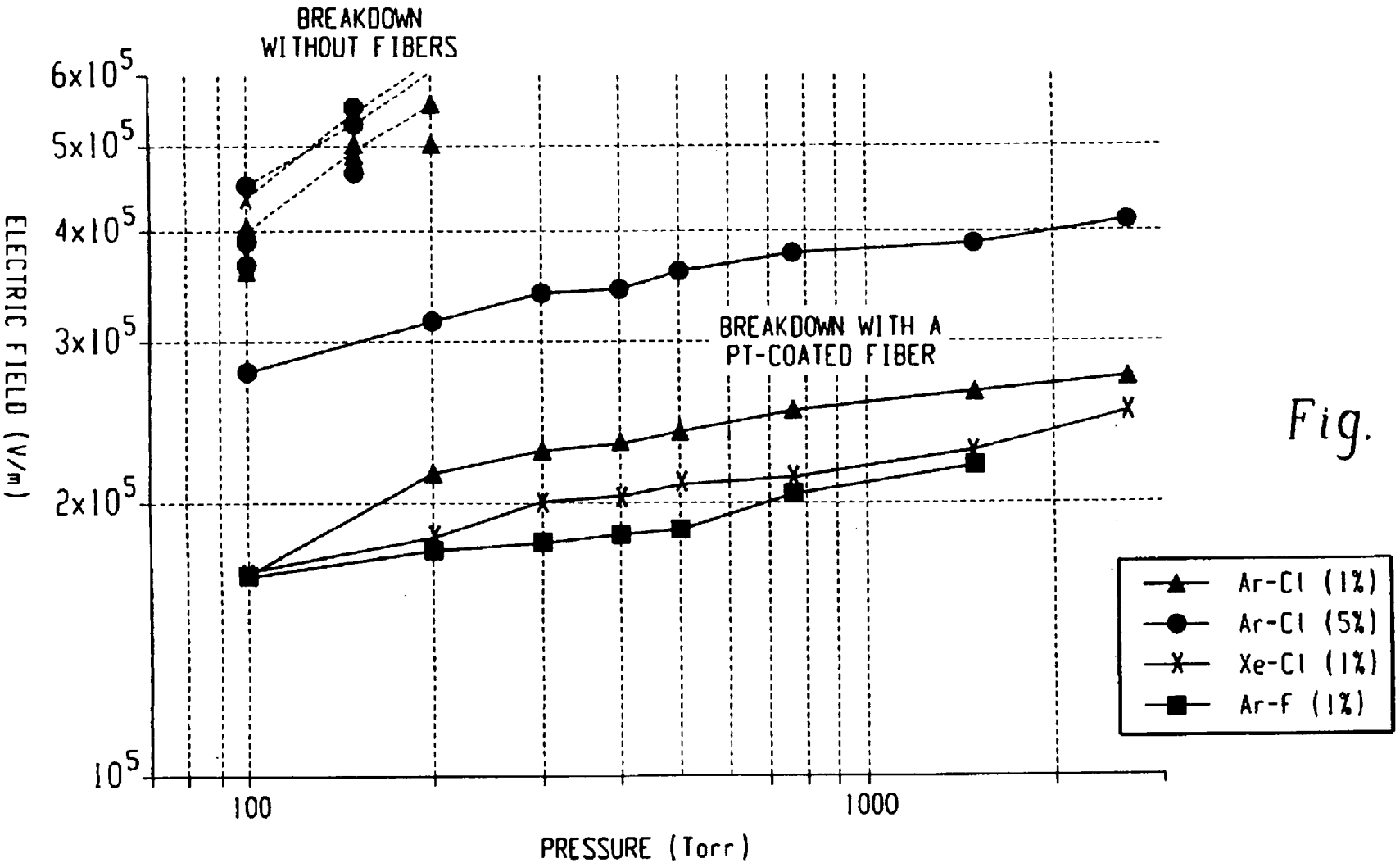
FIG. 9 graphically illustrates the electric field as a function of pressure showing the field strengths required for breakdown of various electronegative gases with and without an enhanced electric field.

FIG. 9 graphically illustrates the breakdown field for various electronegative gas mixtures measured with and without the presence of a platinum SiC coated fiber using the apparatus of FIGS. 6 and 7. Without the presence of the conductive fiber, the breakdown of the gas mixtures did not occur at pressures greater than 200 torr and/or required application of an electrical field in excess of about $6\times10^5$ V/m. In contrast, the presence of the platinum SiC coated fiber within the plasma tube broke down the same gas mixtures at pressures greater than 2,000 Torr and at a significantly lower electric field. In particular, the electric field was less than about $2\times10^5$ V/m for an argon/fluorine gas mixture at pressures from about 100 Torr to greater than about 1,000 Torr.

Figure 10:
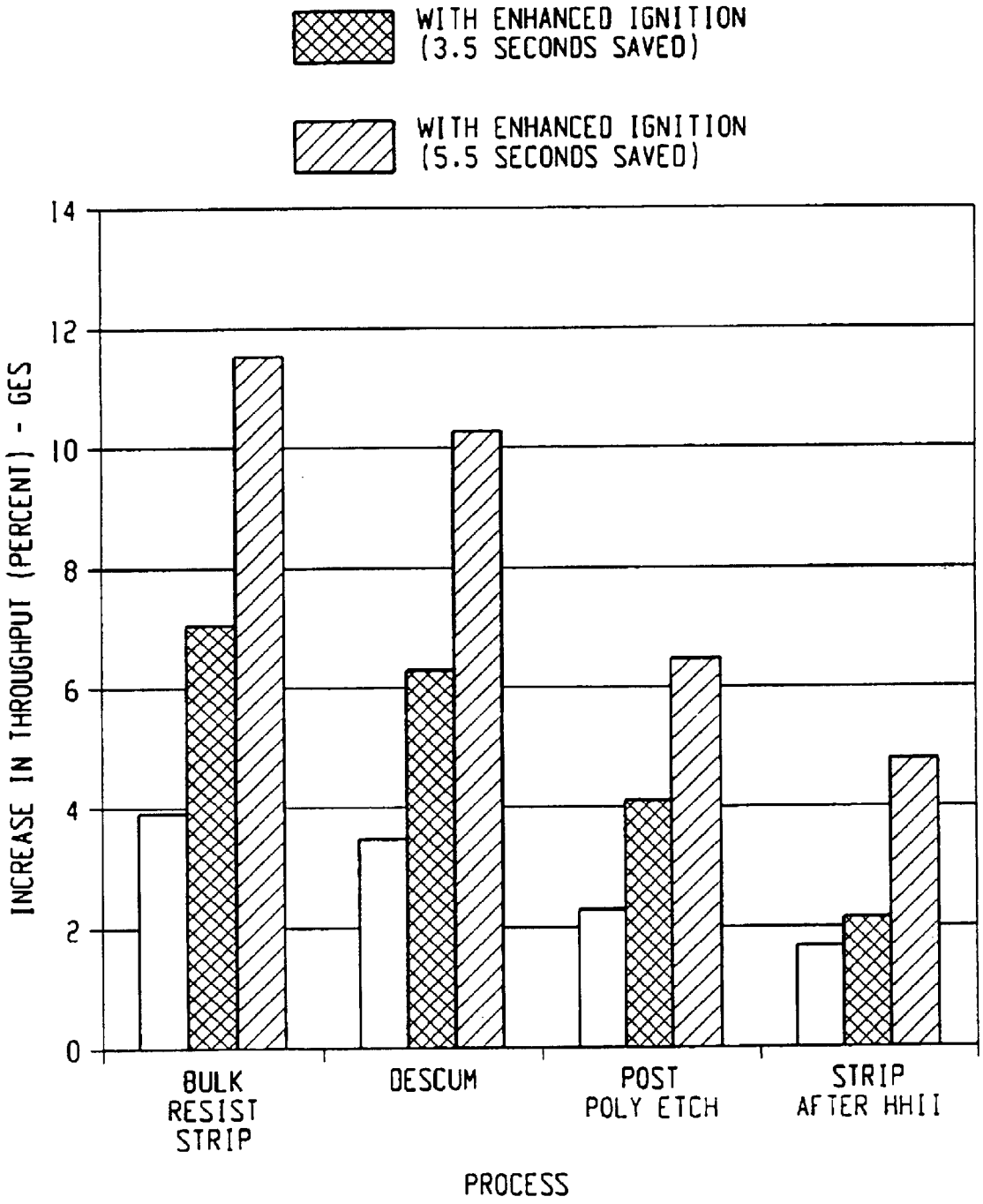
FIG. 10 graphically illustrates wafer throughput for various plasma-mediated processes employed in IC fabrication.

As previously described, some plasma tools utilize tuning hardware for optimizing the electric field breakdown for the particular gas mixture at ignition and also separately during steady state operation. The need to tune for a separate optimized "start" condition is eliminated with the use of the conductive fiber in the plasma tube. Reflected power is minimized since the local electric field generated by the conductive fibers lowers the electric field necessary to breakdown the plasma. As a result, a plasma load is available sooner to absorb microwave power and reduce the amount of reflected power. Significant savings in process time and manufacturing costs can be obtained by eliminating the use of the tuning hardware, e.g., adjustable antenna and short positions for a special "start" condition and positioning of the antenna and short hardware. A commercially available plasma ashing tool that employs tuning hardware is the Fusion ES3i Plasma Asher available from Axcelis Technologies, Inc. Using the Fusion ES3i Plasma Asher as an example, it is estimated that it takes about one second for the antenna to be adjusted once the magnetron is engaged, about one second for the antenna to be adjusted to the preprogrammed "on position" once the plasma is ignited and about 1.5 to about 3.5 seconds for antenna movement for optimization, resulting in a cumulative time of about 3.5 to about 5.5 seconds per wafer for the tuning hardware. Consequently, an immediate increase in wafer throughput will result from eliminating the need for a "start" position or a "start" condition. FIG. 10 illustrates the projected improvements in wafer throughput for various plasma-mediated processes that would result by eliminating the need for a separate "start" condition.

Figure 11:
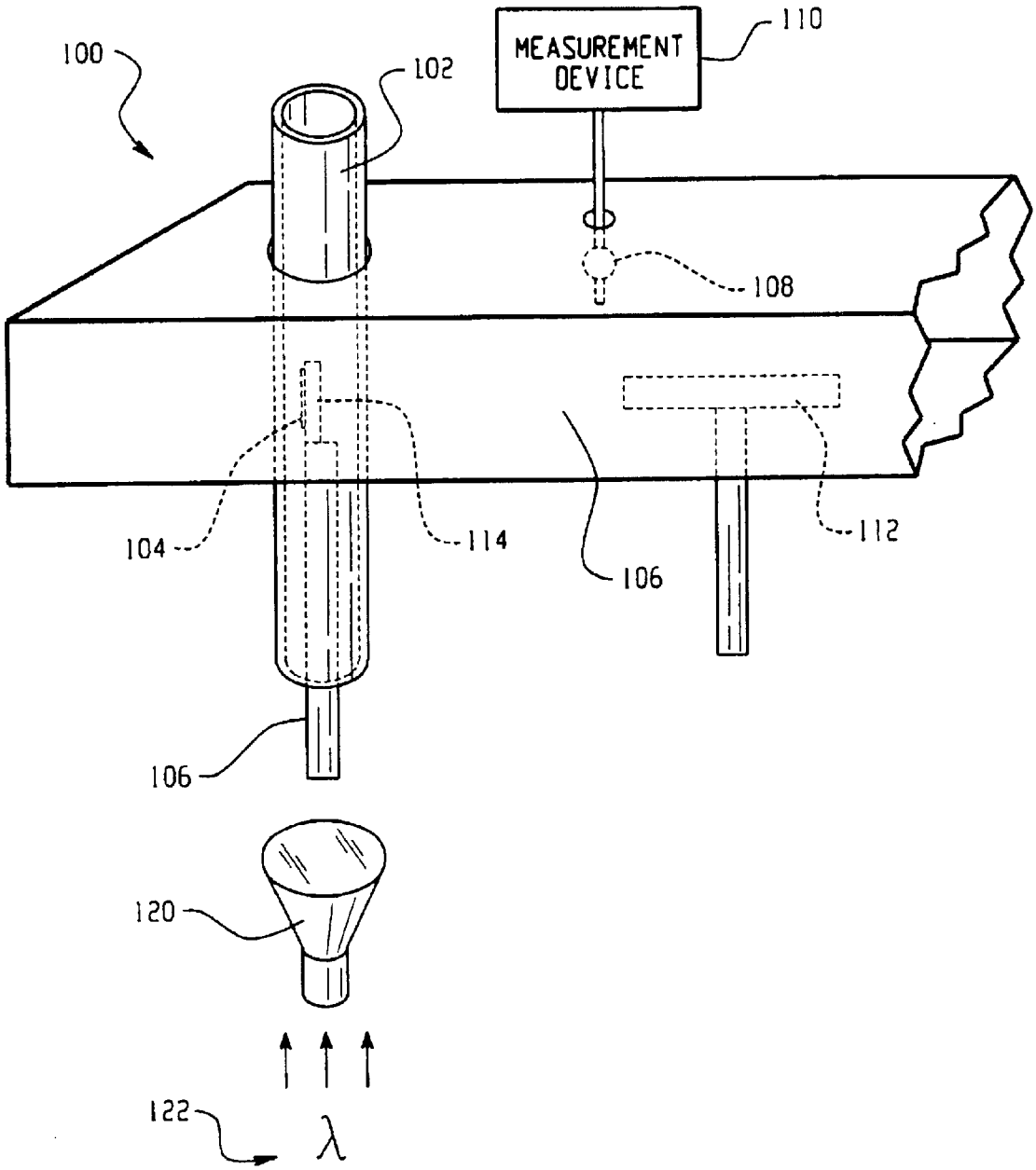
FIG. 11 illustrates the apparatus of FIG. 6 including an illumination source ($\lambda$)

In another embodiment, a light source is focused onto a region near the location of the fiber. FIG. 11 illustrates the apparatus of FIG. 6 configured with the light source 120. Preferably, the light source 120 is an ultraviolet light source and is focused with a lens 122. The UV light reacts with the atmosphere within the plasma tube at the focused location, or with nearby material surfaces, to produce a source of "seed" electrons. It is believed that photons emitted from the light source ionize metastable states of the gas in the atmosphere to produce the seed electrons, or eject photo-electrons from nearby surfaces. The presence of these electrons reduces the breakdown electric field and also makes the breakdown more reproducible and reliable.

Figure 12:
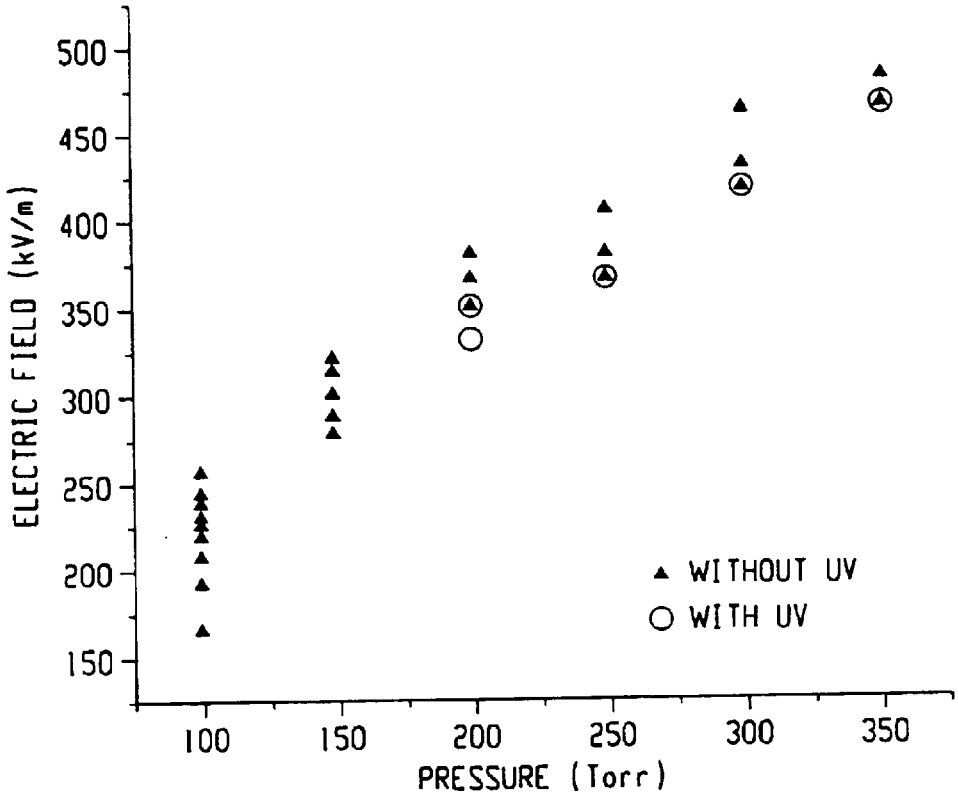
FIG. 12 graphically illustrates the electric field as a function of pressure showing the field strengths required for breakdown of argon gas with and without the additional focused exposure of radiation from the illumination source of FIG. 11.
Figure 13:
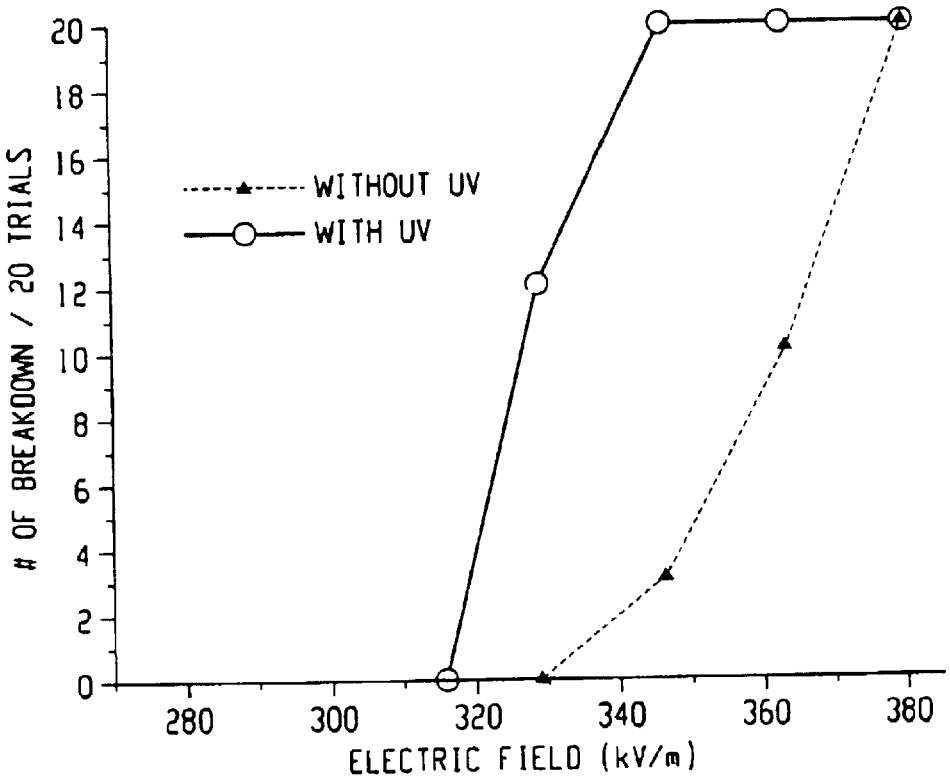
FIG. 13 graphically illustrates the variability of the electric field at breakdown for argon at a constant pressure of 200 Torr with and without focused exposure from the illumination source of FIG. 11.

FIGS. 12 and 13 illustrate the effect of using a UV light source having a primary wavelength of about 254 nm focused at a location near the fiber. FIG. 12 graphically compares the breakdown electrical field for argon gas as a function of pressure with and without the use of UV light. It is observed that the breakdown electric field is stable with the illumination of UV light and is generally less in magnitude than the breakdown electric field generated without the use of UV light. The reduction is believed to be associated with the additional electrons generated by the UV light exposure upon reaction with the atmosphere. FIG. 13 graphically illustrates the reliability associated with and without the use of UV light after cycling the plasma on and off numerous times. The breakdown electrical field was monitored for argon gas at a constant pressure of 200 Torr. The data clearly shows that the use of focused UV illumination increases the operating range by making the ignition more reliable than without UV illumination.

Figure 14:
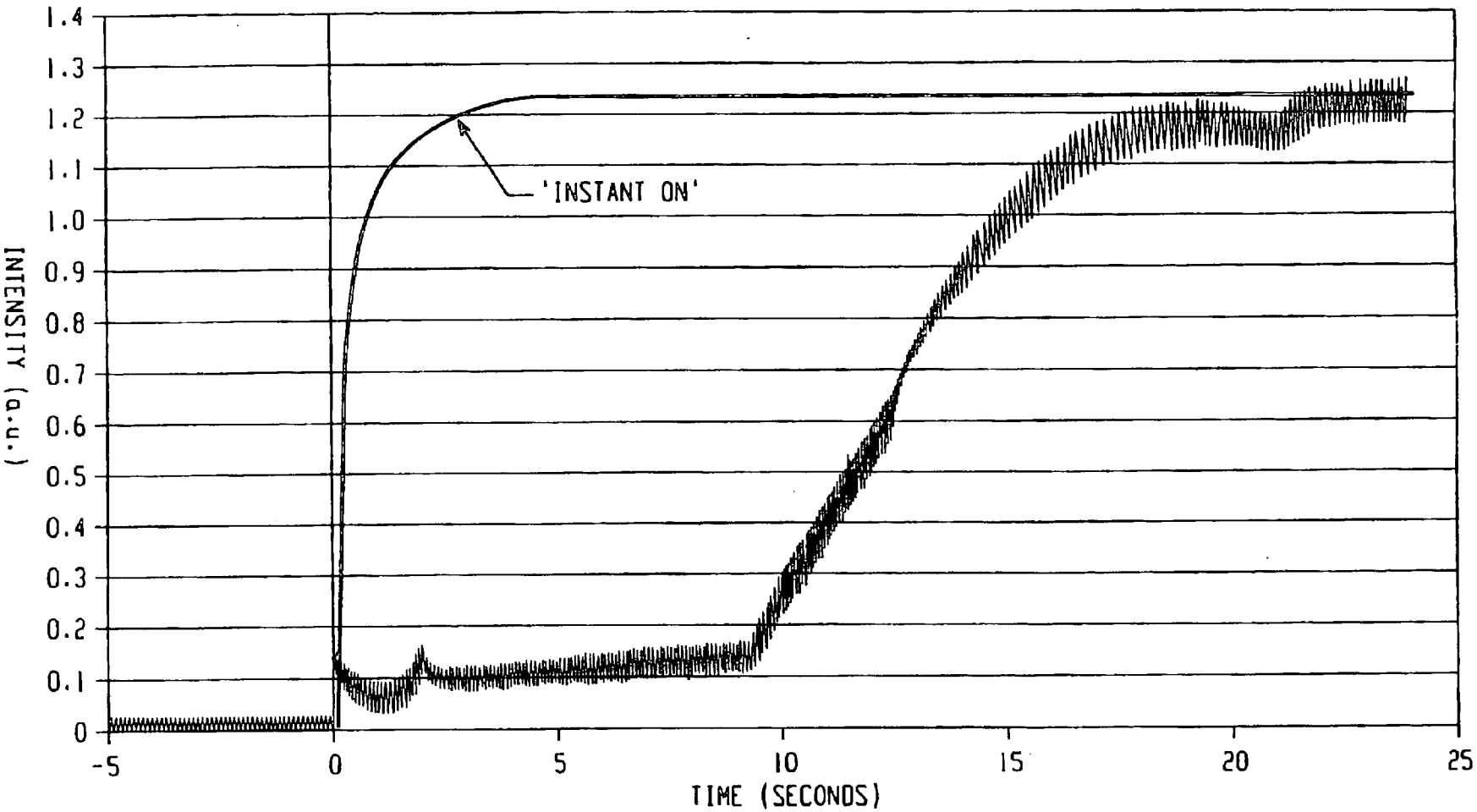
FIG. 14 graphically illustrates plasma intensity as a function of time for a plasma tool with and without an enhanced field.

In addition to improving ignition cycles, the conductive fiber and its use in some plasma applications can be used to reduce run-up time. Once a plasma discharge is initiated (i.e., initial breakdown), there is typically a finite time for the plasma discharge to reach a steady state or equilibrium condition, hereinafter defined as "run-up" time. The use of an enhanced electric field reduces the run-up time. FIG. 14 illustrates the run-up time for a conventional plasma tool compared to a plasma tool including the enhanced electric field, i.e., conductive fiber in close proximity to the plasma discharge volume. The intensity of the plasma discharge in a conventional plasma tool (without the use of a conductive fiber) reaches a steady state after about 15 seconds. In contrast, the use of a plasma tool with the enhanced electric field (with the use of a conductive fiber) reaches a steady state after about 1 second, a savings of about 14 seconds. Tables I and II shows the effect on wafer throughput of reducing the run-up time for typical processes utilized in the fabrication of the IC. Table I illustrates typical results of a conventional plasma tool without the use of an enhanced electric field whereas Table II illustrates the results of the same plasma tool with the enhanced electric field.

TABLE I

| | WITHOUT CONDUCTIVE FIBER | | | | |
|---|---|---|---|---|---|
| | Low (sec.) | High (sec.) | Overhead (sec.) | Total (sec.) | Wafers per Hour |
| Polyoxide etch | 10 | 40 | 18 | 68 | 53 |
| Metal Etch | 10 | 47 | 20 | 77 | 48 |
| Si Trench etch | 10 | 80 | 43 | 133 | 27 |
| Metal etch (2) | 10 | 80 | 43 | 133 | 27 |
| EPROM | 0 | 60 | 15 | 75 | 48 |
| Optimized NVM | 0 | 45 | 15 | 60 | 60 |
| Typical short | 10 | 35 | 15 | 60 | 60 |

TABLE II

| | WITH CONDUCTIVE FIBER | | | | | | | |
|---|---|---|---|---|---|---|---|---|
| | Low (sec.) | High (sec.) | Overhead (sec.) | Total (sec.) | On time Savings (sec.) | Total time (sec.) | Wafers per Hour | % Increase in throughput |
| Polyoxide etch | 10 | 40 | 18 | 68 | 7.5 | 60.5 | 60 | 12.4 |
| Metal Etch | 10 | 47 | 20 | 77 | 7.5 | 69.5 | 52 | 10.8 |
| Si Trench etch | 10 | 80 | 43 | 133 | 7.5 | 125.5 | 29 | 6.0 |
| Metal etch (2) | 10 | 80 | 43 | 133 | 7.5 | 125.5 | 29 | 6.0 |
| EPROM | 0 | 60 | 15 | 75 | 2.5 | 72.5 | 50 | 3.4 |
| Optimized NVM | 0 | 45 | 15 | 60 | 2.5 | 57.5 | 63 | 4.3 |
| Typical short | 10 | 35 | 15 | 60 | 7.5 | 52.5 | 69 | 14.3 |

By elimination of the run-up time, the throughput can be increased as much as about 15% for certain recipes, such as that for poly/oxide etch, metal etch and other recipes that require low power operation.

According to the foregoing, the advantages of the invention include at least the following:

1. At a fixed electric field, the present disclosure allows ignition of gases at pressures over one order of magnitude greater than without the enhanced electric field.
2. The present disclosure permits ignition of certain gases at pressures up to about 5 atmospheres, whereas ignition of certain gases is only possible up to about 150 to about 200 mtorr.
3. At a fixed gas pressure, the present disclosure allows ignition of gases with applied electric fields much lower than previously possible.
4. The present disclosure permits ignition of gases in previously impossible conditions. As a result, the present disclosure increases the operating regime of plasma tools.
5. A reduction of delay times between when power is applied to the plasma tool and the time at which the plasma is created. For example, in the case of microwave energy sources, the present disclosure increases the operating lifetime of the magnetron.
6. The present disclosure eliminates the need to retune microwave cavities between startup and steady-state operation, thus eliminating complexity, hardware, cost, and consequently improving reliability.
7. The present disclosure shortens the time to full-on conditions (i.e., reduces run-up time) in plasmas, thus improving the throughput.
8. The present disclosure eliminates the need for external auxiliary starting devices.

The foregoing descriptions of the preferred embodiments of the invention have been presented for purposes of illustration and description. It is not intended to be exhaustive or to limit the invention to the precise forms disclosed. Obvious modifications or variations are possible in light of the above teachings. The embodiments were chosen and described to provide the best illustration of the principles of the invention and its practical applications to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A plasma tube comprising:

an open ended cylindrical body, wherein the body includes a gas inlet at one end, and an outlet at an other end; and at least one conductive fiber secured to the body and positioned to enhance an electric field, wherein the at least one conductive fiber is free from connection to a voltage power source.

2. The plasma tube according to claim 1, wherein a portion of the conductive fiber is encased within a protective coating.

3. The plasma tube according to claim 2, wherein the protective coating comprises a dielectric material.

4. The plasma tube according to claim 3, wherein the dielectric material is silicon dioxide.

5. The plasma tube according to claim 1, wherein a portion of the conductive fiber is in contact with the body.

6. The plasma tube according to claim 1, wherein the conductive fiber comprises a material selected from the group consisting of tantalum, tungsten, gold, copper, silver, molybdenum, aluminum, carbon, graphite, palladium, platinum, ceramics, and composites or compositions comprising at least one of the foregoing materials.

7. The plasma tube according to claim 1, wherein the conductive fiber is a platinum coated silicon carbide fiber.

8. The plasma tube according to claim 1, wherein the conductive fiber comprises a length of less than about 10 millimeters.

9. The plasma tube according to claim 1, wherein the conductive fiber comprises a length of about 3 millimeters to about 5 millimeters.

10. The plasma tube according to claim 1, wherein the cylindrical body comprises a material selected from the group consisting of sapphire, quartz, alumina coated quartz and combinations comprising at least one the materials.

11. The plasma tube according to claim 10, wherein the conductive fiber is secured to the body at an angle substantially parallel to a length of the tube.

12. The plasma tube according to claim 10, wherein the at least one fiber has a thickness less than about 100 microns.

13. The plasma tube according to claim 1, wherein the conductive fiber is secured to an inner surface of the plasma tube.

14. The plasma tube according to claim 1, wherein the at least one conductive fiber is separated from an additional conductive fiber by a distance greater than about 3 millimeters.

15. A plasma tool comprising:

a plasma generating chamber comprising a plasma tube, wherein the plasma tube comprises an open ended cylindrical body, wherein the body includes a gas inlet at one end an outlet opening at an other end, and at least one conductive fiber secured to the body and positioned to enhance an electric field, wherein the at least one conductive fiber is free from connection to a voltage power source; and an energy source in operative communication with the plasma tube.

16. The plasma tool according to claim 15, wherein the energy source is selected from the group consisting of microwave energy, radiofrequency energy, and a combination comprising at least one of the foregoing energy sources.

17. The plasma tool according to claim 15, wherein the conductive fiber is encased with a dielectric material.

18. The plasma tool according to claim 15, wherein the conductive fiber comprises a material selected from the group consisting of tantalum, tungsten, molybdenum, aluminum, carbon, graphite, palladium, gold, copper, silver, platinum, ceramics, and composites or compositions comprising at least one of the foregoing materials.

19. The plasma tool according to claim 15, wherein the conductive fiber is a platinum coated silicon carbide fiber.

20. The plasma tool according to claim 15, wherein the conductive fiber is secured to an inner surface of the plasma tube.

21. The plasma tool according to claim 15, further comprising a light source, wherein radiation emitted from the light source is focused at a point within the plasma tube.

22. The plasma tool according to claim 21, wherein the radiation comprises ultraviolet radiation.

23. The plasma tool according to claim 21, wherein the at least one fiber has a thickness less than, about 100 microns.

24. The plasma discharge tool according to claim 15, wherein the at least one fiber is at least partially aligned with the electric field.

25. The plasma discharge tool according to claim 15, wherein the at least one fiber is at substantially parallel to the applied electric field.

26. The plasma tube according to claim 15, wherein the at least one conductive fiber is separated from an additional conductive fiber by a distance greater than about 3 millimeters.

27. A process for reducing the electric field breakdown point of a gas, the process comprising:

securing a conductive fiber to a surface of a plasma tube, wherein the plasma tube comprises an open ended cylindrical body, wherein the body includes a gas inlet at one end, an outlet at an other end, and at least one conductive fiber in contact with the body and positioned to enhance an electric field, wherein the at least one conductive fiber is free from connect on to a voltage power source;

flowing a gas into the gas inlet of the plasma tube;

applying an electric field to the gas flowing in the plasma tube to form a plasma; and discharging the plasma from the outlet of the plasma tube.

28. The process according to claim 27, further comprising focusing radiation emitted from a light source at a point within the plasma tube.

29. The process of claim 27, wherein the applied electric field is generated from an energy source selected from the group consisting of microwave energy, radiofrequency energy, and combinations comprising at least one of the energy sources.

30. The process of claim 27, wherein the conductive fiber comprises a material selected from the group consisting of tantalum, tungsten, gold, copper, silver, molybdenum, aluminum, carbon, graphite, palladium, platinum, ceramics, and composites or compositions comprising at least one of the foregoing materials.

31. The process of claim 27, wherein the conductive fiber is secured to the body at an angle substantially parallel to the plasma tube.

32. The process of claim 27, wherein the at least one fiber has a thickness less than about 100 microns.

33. The process of claim 27, wherein the gas flows at a pressure less than 1 atmosphere.

34. The process according to claim 27, further comprising securing an additional conductive fiber to the plasma tube positioned to enhance the electric field, wherein the additional conductive fiber is separated from the conductive fiber by a distance greater than about 3 millimeters.

35. The process according to claim 27, wherein the gas flows at a pressure greater than 1 atmosphere.

36. The process according to claim 27, wherein the gas flows at a pressure up to about 5 atmospheres.

37. A plasma tube comprising:

an open ended cylindrical body, wherein the body includes a gas inlet at one end, and an outlet at an other end; and at least one conductive fiber secured to the body and positioned to enhance an electric field, wherein the at least one conductive fiber is free from connection to a voltage power source and wherein the conductive fiber comprises a length of less than about 10 millimeters.

* * * * *